US007705864B2

(12) United States Patent
Ahmed et al.

(10) Patent No.: US 7,705,864 B2
(45) Date of Patent: Apr. 27, 2010

(54) USER SELECTABLE HARDWARE ZOOM IN A VIDEO DISPLAY SYSTEM

(75) Inventors: Kamran Ahmed, Montreal (CA); James Anglehart, Montreal (CA); Alexandre Lahaise, Pierrefonds (CA); Jean Lapointe, Blainville (CA); Martin Pilot, Blainville (CA); Daniel T. Wood, Montreal (CA)

(73) Assignee: Matrox Graphic Inc., Dorval, Quebec (CA)

( * ) Notice: Subject to any disclaimer, the term of this patent is extended or adjusted under 35 U.S.C. 154(b) by 0 days.

(21) Appl. No.: 11/247,165

(22) Filed: Oct. 12, 2005

(65) Prior Publication Data

US 2006/0050090 A1 Mar. 9, 2006

Related U.S. Application Data

(63) Continuation of application No. 09/526,441, filed on Mar. 16, 2000, now abandoned.

(51) Int. Cl.
*G09G 5/373* (2006.01)

(52) U.S. Cl. ..... 345/667; 345/1.1

(58) Field of Classification Search ..... 345/635, 345/661, 665, 667–671, 698, 699, 1.1, 3.1–3.4, 345/503, 539, 544
See application file for complete search history.

(56) References Cited

U.S. PATENT DOCUMENTS 4,751,507 A * 6/1988 Hama et al. ..... 715/784
5,027,110 A * 6/1991 Chang et al. ..... 345/668
5,300,948 A * 4/1994 Tsujido et al. ..... 345/539
5,886,682 A * 3/1999 Biggs ..... 345/605
5,936,606 A * 8/1999 Lie ..... 345/629
6,288,702 B1 * 9/2001 Tachibana et al. ..... 345/671
6,515,678 B1 * 2/2003 Boger ..... 345/660
6,788,309 B1 * 9/2004 Swan et al. ..... 345/629

OTHER PUBLICATIONS

Millennium G400 • Millennium G400 MAX User Guide; 10526-301-0510; May 21, 1999; pp. 1, 10, and 29; http://techpubs.sgi.com/library/manuals/0000/860-0220-001/pdf/860-0220-001.pdf.*
Marvel G400-TV User Guide; 10664-301-0100; Sep. 24, 1999; pp. 1, 23, and 24; http://www.matrox.com/graphics/media/common/user_manuals/marv_g400/mvg4_eng.pdf.*

(Continued)

*Primary Examiner*—Jeffery A Brier
(74) *Attorney, Agent, or Firm*—Ogilvy Renault LLP

(57) ABSTRACT

A display controller system is controlled to provide a display surface zoom using hardware scaling from user input at the operating system, application program or hardware level. User input defining coordinates of a frame portion within a frame buffer memory is obtained, and a resolution of the zoom display device is determined. An aspect ratio of the zoom portion defined by the user input is adjusted to correspond to the zoom display device resolution. The display controller system is programmed to implement the display surface zoom to provide a full screen view of the zoom portion on the zoom display device. In the display controller system, the zoom portion of the frame buffer memory is scaled, converted into a display signal and output.

26 Claims, 8 Drawing Sheets

OTHER PUBLICATIONS

Marvel G200 • Marvel G200-TV User Guide; 10615-301-0201; Dec. 11, 1998; pp. 1 and 24; http://www.matrox.com/graphics/media/common/user_ manuals/marv_g200/marv_eng.pdf.*

Activewin product review; Product: Matrox Millennium G400 32MB Dual Head; Company: Matrox; Review By: Byron Hinson Nov. 28, 2007, pp. 1-4; http://www.activewin.com/reviews/hardware/graphics/matrox/g400/g400_32mb_ 5.shtml.*

Activewin product review; Product: Matrox Millennium G400 32MB Dual Head; Company: Matrox; Review By: Byron Hinson Oct. 12, 1999, pp. 1-3; http://web.archive.org/web/19991012215141/http://activewin.com/reviews/hardware/graphics/matrox/g400/g400_32mb_5.shtml.*

Matrox graphics for professionals Media Creation and Editing, Nov. 28, 2007, http://www.matrox.com/graphics/en/crepro/products, pp. 1-3.*

Matrox graphics for professionals support center user guides, Nov. 28, 2007, http://www.matrox.com/graphics/en/corpo/support/manuals/home.php, pp. 1-2.*

Greg Loveria, Easing Windows' Graphics Bottleneck, Jul. 1994, BYTE, pp. 1-15; http://www.byte.com/art/; http://www.byte.com/art/9407/9407.htm; http://www.byte.com/art/9407/sec10/art2.htm.*

Matrox Graphics Architecture Matrox Millennium II for Mac Installation Guide, 10546-101-0110 Oct. 10, 1997, pp. 1-12, http://www.matrox.com/graphics/media/pdf/support/manuals/en_mac2.pdf.*

Matrox Graphics Architecture MGA Millennium Installation Guide Manual: 10418-101-0200, Mar. 20, 1996, pp. 1-28, http://supportapj.dell.com/support/edocs/video/54001/54001c.pdf.*

Installing and Using Windows 95 with Matrox MGA Millennium, Sep. 8, 1995, pp. 1-3, http://crydee.sai.msu.ru/ftproot/pub/comp/hardware/matrox/doc/w95hlpm1.doc.*

MGA Matrox Graphics Architecture MGA Millennium for PCI PowerMac Installation & User Guide, 10448-200-0100, Jan. 15, 1996, pp. 1-12, http://sysdoc.doors.ch/MATROX/millmac.pdf.*

* cited by examiner

USER SELECTABLE HARDWARE ZOOM IN A VIDEO DISPLAY SYSTEM

CROSS-REFERENCE TO RELATED APPLICATIONS

The present application is a continuation of U.S. patent application Ser. No. 09/526,441, filed on Mar. 16, 2000, now abandoned the contents of which are hereby incorporated by reference.

FIELD OF THE INVENTION

The present invention relates to a method and associated apparatus for providing a user selectable hardware zoom in a video display system.

BACKGROUND OF THE INVENTION

Computers are important tools in today's society, and the computer display is an essential component of one's workspace. The importance of computer displays for the efficiency of work is demonstrated by the presence of larger displays and multiple displays when the display "real estate" becomes important to one's work. In some cases, larger displays allow for more "real estate" to be displayed. Dual displays are usually driven by independent display controllers, and the operating system (e.g. Windows 98™) is informed that the "desktop" or display surface is to be displayed on one side by one display controller and on the other side by the other display controller. This is typically done using two independent graphics subsystem accessing two separate and independent memory subsystems. Dual displays have an advantage over larger displays in many cases because with CRT monitors, the depth of the monitor is in proportion to the screen size, and large screens take up significant physical desktop surface area. It can sometimes be impossible to set up a 20" CRT monitor, while it is possible to set up two 15" monitors on the same desktop surface. The cost of two 15 inch monitors is also typically less than half that of one 20 inch monitor.

While providing a greater physical surface area for the computer display output provides satisfactory results in many work environments, there is a need to have better display detail for work requiring attention to detail, such as graphics work, in which a zoom or scaling of the area to be worked on is essential. Conventional zoom is done by the application programs themselves, i.e. the user selects a zoom level for a display, and the application provides a magnified view of the object being worked on, such as a document, drawing or image; mostly, this zoom covers or replaces the previous image on the display. Some application programs provide a smaller window with a representation of a whole page of a document or image, while the main viewing portion of the display provided the zoomed image.

Conventional zooming techniques operate to satisfaction when the applications provide them, however, the user often needs to command the application program to switch between zoom levels in order to edit a document correctly, since perspective is essential to proper editing. There is therefore a need to provide for a display-based zoom for providing a user with the ability to view an accurate zoom of a portion of a main display surface on one display, while being able to view the entire main display surface on the other in the case of multiple monitor configuration.

It is also known in the art to provide a single display controller hardware zoom in which the zoom operates to scale a fixed portion of a main surface memory, such as, for example, an area which is one quarter the size of the main surface memory, in which each pixel of the main surface memory is displayed as four pixels in the zoom display. The portion of the main surface memory can be displaced or dragged using the mouse. The known hardware zoom does not provide for a user defined magnification ratio to be used, and is limited to a fixed or a set of pre-defined magnification ratios,

SUMMARY OF THE INVENTION

It is an object of the present invention to provide a method for implementing a hardware zoom in which a user specifies a point and a dimension of a window or frame associated with the point within a main display, and the hardware zoom automatically scales a maximum portion of the window selected to a full screen view. The full screen zoom may be provided on a different display than the main display, with the main display remaining unchanged by the selection. This allows the user to simply define any area on the display using an input device with the result that the window automatically gets scaled full screen. This offers the flexibility of not limiting the user to determine a scale factor, but to instead define the area that they are interested in working on and having it zoomed full screen to the desired display and resolution. Once the frame has been defined, the frame can be moved relative to the movement of an input device if a panning feature is enabled.

It is also an object of the present invention to provide a method for implementing a hardware zoom which allows for a non-integer fraction of a main display surface memory to be zoomed. By a non-integer fraction is meant a fraction which is not 1/n, where n is an integer, and thus a 1:n scaling is not possible. Such non-integer fractions, as user defined by selecting a zoom window using a GUI, provide a more user friendly operation.

In accordance with a first broad aspect of the present invention, there is provided a method of controlling a display controller system to provide a display surface zoom, said display controller system having a main surface in a frame buffer memory and output to at least one zoom display device, the method comprising the steps of: receiving user input defining coordinates of a frame portion within said main surface in the frame buffer memory; determining a resolution of said at least one zoom display device and adjusting an aspect ratio of said portion defined by said user input to correspond to said resolution; programming said display controller system to implement said display surface zoom to provide a full screen view of said portion on said at least one zoom display device; in said display controller system, scaling said portion of said main surface in the frame buffer memory; in said display controller system, converting said scaled portion of said main surface in the frame buffer memory into a display signal; and outputting said display signal from said display controller system to said at least one zoom display device.

In accordance with a second broad aspect of the present invention, there is provided a method of controlling a display controller system to provide a display surface zoom, said display controller system having a main surface in a frame buffer memory and output to at least one zoom display device, the method comprising the steps of: receiving user input defining coordinates of a fractional portion of said main surface in the frame buffer memory to be scaled and displayed, said fractional portion being a non-integer fraction of said main surface of the frame buffer memory; determining a resolution of said at least one zoom display device and adjusting an aspect ratio of said portion defined by said user input to correspond to said resolution; programming said display controller system to implement said display surface zoom to provide full screen view of said portion on said at least one zoom display device; scaling said portion of said main surface in the frame buffer memory; converting said scaled portion of said main surface in the frame buffer memory into a display signal; and outputting said display signal to said at least one zoom display device.

There are two basic ways of determining the resolution of the zoom display device and adjusting the aspect ratio of the portion. The first way is to determine the suitable aspect ratio based on the resolution of the zoom display and to force the user selection of the frame portion to choose a frame portion of the same aspect ratio. The second way is to allow the user to define any frame portion and then to adjust the frame portion with respect to the aspect ratio based on the resolution of the zoom display.

According to aspects of this invention, one graphics controller with one or multiple Cathode Ray Tube Controllers (CRTC's) allows the user to select any rectangular area (zoom window) on one display and have it zoomed full screen on the second display (or on any other of a larger number of displays) in realtime.

The zoom on the second display can be filtered to avoid pixelation (i.e. an image not illustrating coarse pixels) or unfiltered (i.e. an image illustrating coarse pixels) to facilitate pixel by pixel viewing and editing. User input can also define a user's choice of filtering or non-filtering.

The location of the selected zoom area once defined can be static in order to fix the zoom window on one region of the display or locked to the movement of any user input through an input device (keyboard, absolute or relative pointing device, e.g. mouse). This user input may further include a cursor control device input used to control a cursor, and the portion of the main surface memory to be scaled and output is caused to be dragged or moved over the main surface memory b movement of the cursor.

With the present invention, the user can view both the entire application (or the desktop in general) on one screen and any area of this desktop zoomed to full screen on the second display. This can be extended to include multiple defined areas on multiple secondary displays and even multiple defined areas on one secondary display. For the latter, the user will need to toggle between the various zoom areas once they have been defined.

The user may also reselect a different area or zoom window (any size) whenever desired.

It is also possible to use a single display device, and to toggle between a display of the main surface memory and one of the user selected zoom windows on the same display. In the case of a multiple display desktop displaying the main surface memory, the invention may also allow the user to toggle between a zoom window and the main surface memory for one or all display devices.

The invention may also provide for an automatic recognition of an application program being run on the user's computer and to store user defined zoom window parameters in association with a particular application program. In this way, user activation of the zoom function can cause the particular window or set of windows associated with the application program to be displayed on the zoom display. Thus switching between applications programs may automatically cause the zoom window to change accordingly.

BRIEF DESCRIPTION OF THE DRAWINGS

The invention will be better understood by way of the following non-limiting detailed description of a number of preferred embodiments with reference to the appended drawings, in which.

DETAILED DESCRIPTION OF THE PREFERRED EMBODIMENTS

In the first preferred embodiment, two independent display controllers (a primary display and a secondary display controller) are each able to generate a stream of pixel data and associated synchronization signals (syncs) from pixel data contained in a display memory (surfaces). The two display controllers can drive a variety of output ports including any combination of RGB D/A converters, video encoder, and TDMS Panel Link or LCD interface. This permits many display combinations such as but not limited to two RGB monitors, two TV monitors, two flat panel displays or any mix of them.

Figure 1:
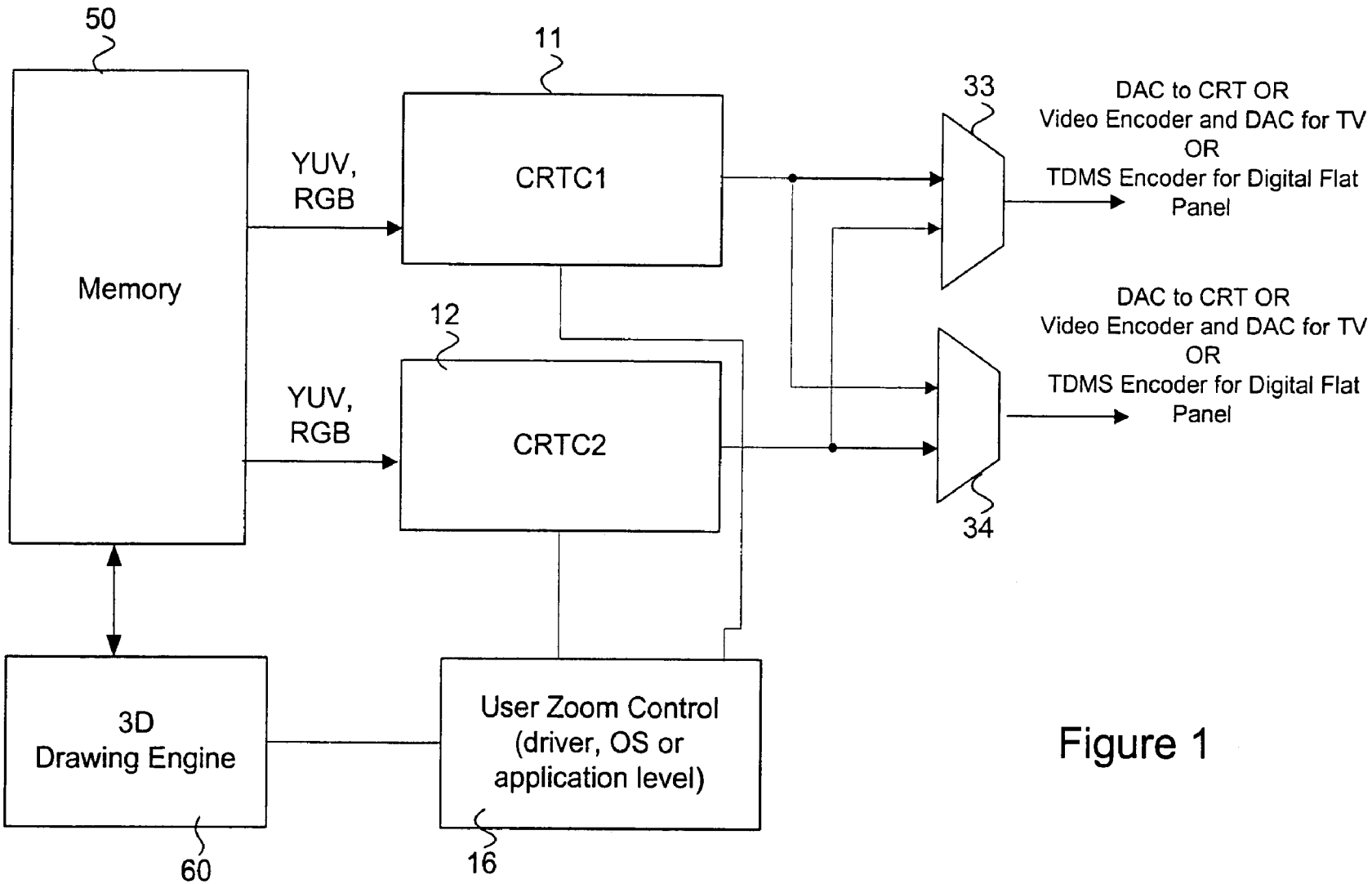
FIG. 1 is a high level block diagram of the display controller system according to the first preferred embodiment.

FIG. 1 shows a high level block diagram of the preferred embodiment. Two CRTC's 11 and 12 are capable of fetching one or more display surfaces from a single frame buffer memory (50) which can be SGRAM, SDRAM, or any other type of Random Access Memory (RAM). Each CRTC may also contain one or more backend scalers that allows the input surfaces to be re-scaled. While, within the context of the present invention, each controller 11 and 12 does not need to access more than one surface, greater image processing and display ability may be provided when multiple surfaces can be accessed by each controller.

These surfaces can be in a variety of pixel formats including but not limited to RGB (8, 16, 24, 32) and YUV (4:2:0, 4, 2, 2): The output of each CRTC can be displayed on a CRT monitor, TV or flat Panel displays via appropriate converters, encoders and transmitters. The multiplexers 33 and 34 allow routing of the output of each CRTC to either display. This allows either display to receive the output from either CRTC.

The user zoom controller 16 in the preferred embodiments is provided by software at the level of at least the device driver and utilities which allow the user to select from a variety of options to use the zoom capabilities. These can include but are not limited to: Filtering: on or off; Panning or Mouse Following: on or off; Destination resolution: Automatic or user defined (from any allowed resolution); Toggling between different zoomed surfaces and/or main display surface; and Enabling and disabling association with applications.

Enabling and disabling zoom is done via (but riot limited to) pre assigned (or user defined) Hot-keys or other combinations of keys (or mouse buttons) or icon buttons etc. Furthermore each of the above options can be easily toggled on and off or they can be automatic and user defined using pre-assigned (or user defined) hot keys or the like.

Figure 2:
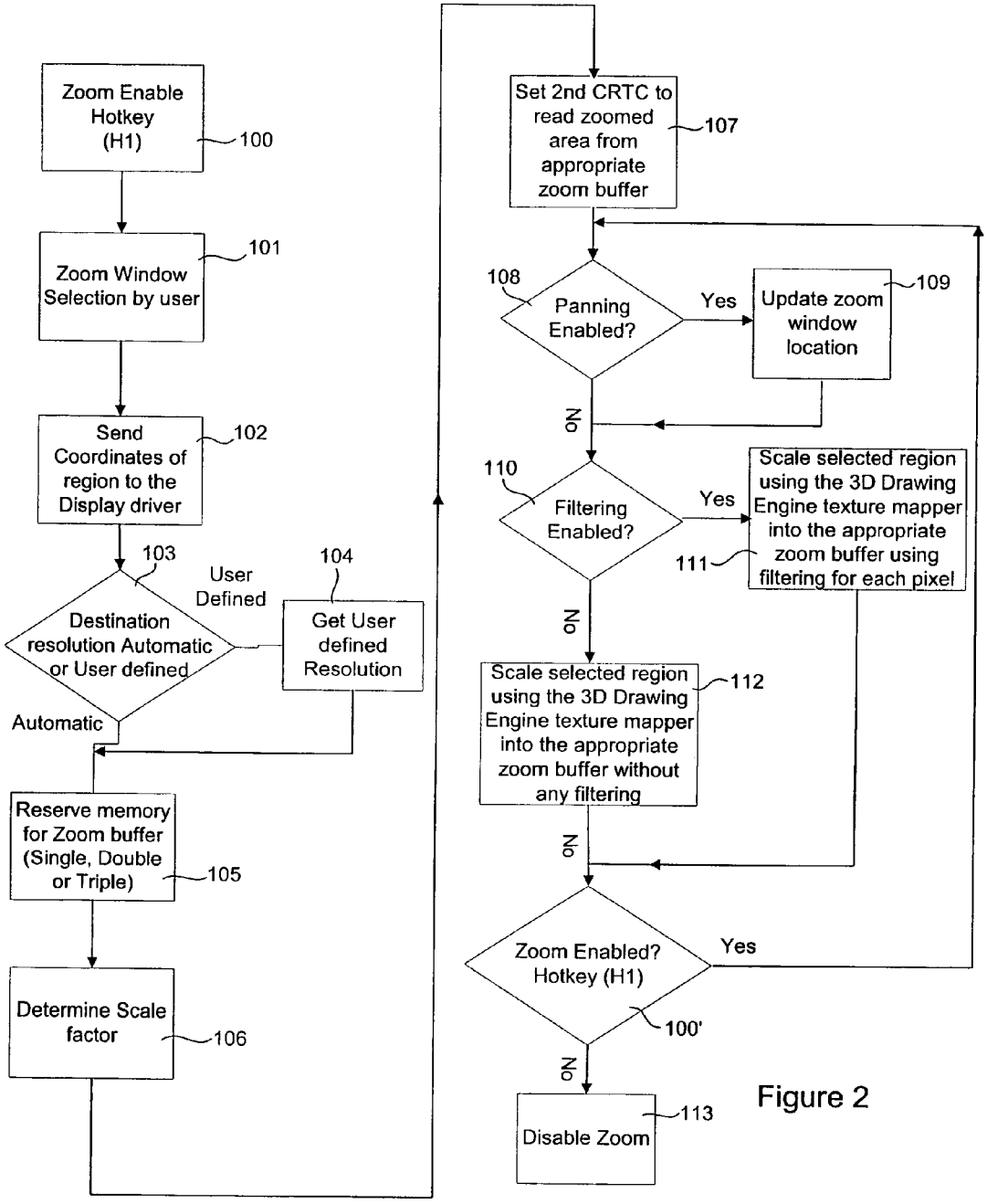
FIG. 2 is a flow chart of the zoom control process according to the second preferred embodiment in which scaling is performed using a 3D drawing engine.
Figure 4:
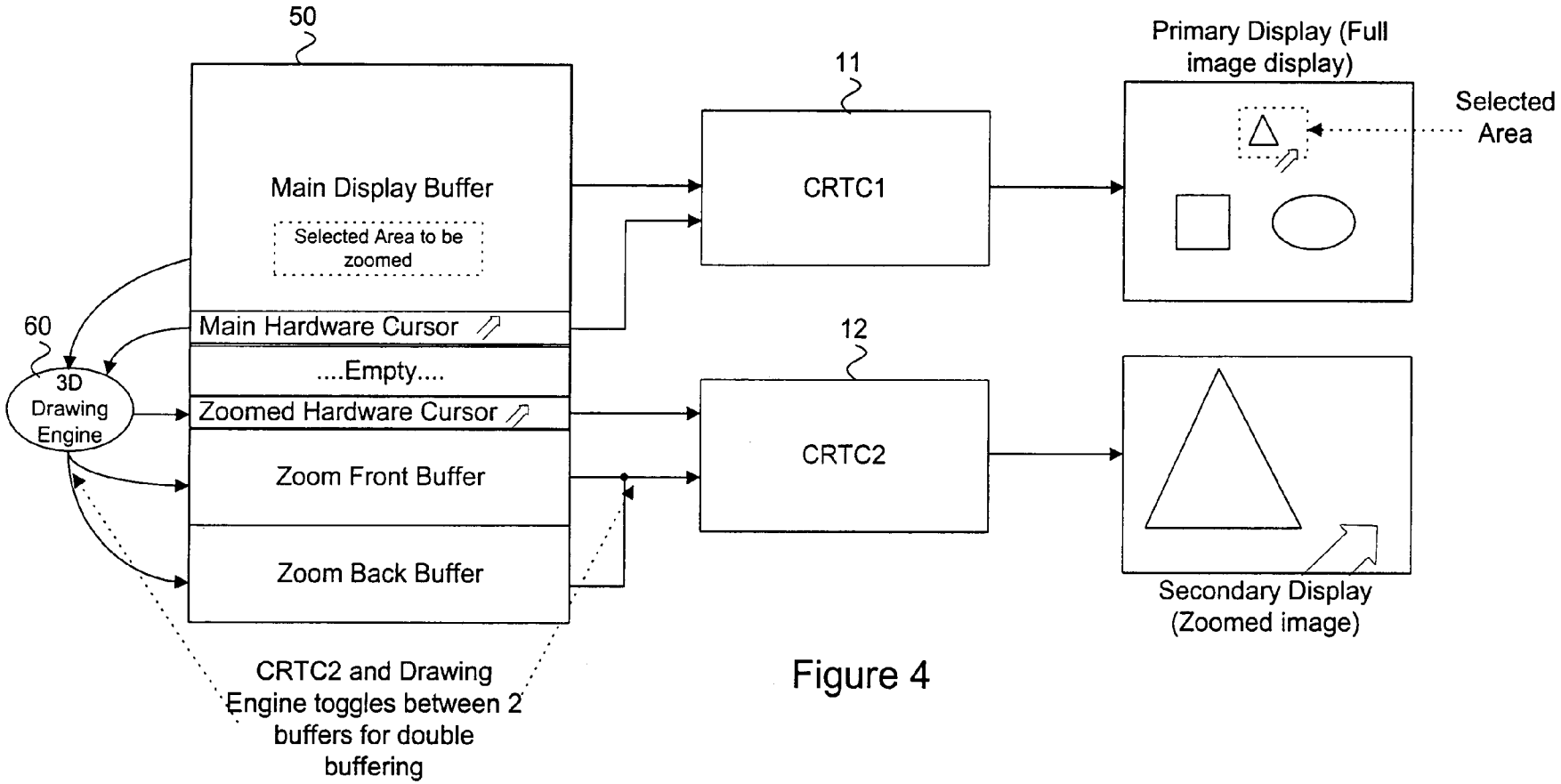
FIG. 4 is a high level block diagram illustrating the display controller system according to the second preferred embodiment in which the zoomed display toggles between two buffers and a zoomed hardware cursor is provided and the scaling is performed using a 3D drawing engine.
Figure 5:
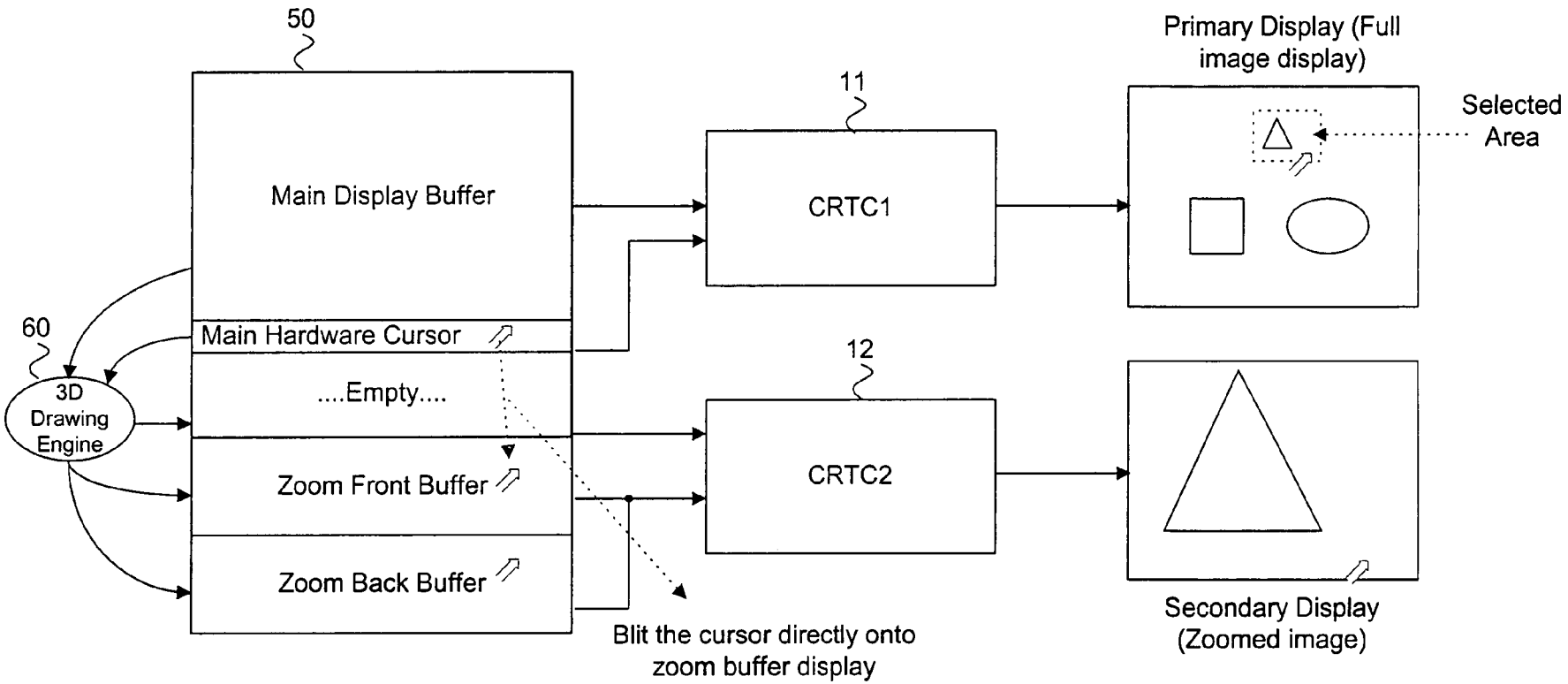
FIG. 5 is a high level block diagram illustrating the display controller system according to the third preferred embodiment in which the zoomed display toggles between two buffers and the main hardware cursor is blit directly onto the zoom buffers.

FIG. 2 shows a flow chart for the embodiment illustrated in FIGS. 4 and 5. When the end user enables the zoom using a hotkey (H1) or the like in step 100, the software allows the user to select a rectangular window from the primary display in step 101. One example of this could be that the user holds down the mouse key at which point the coordinates of one corner of the zoom window are determined. The user then drags the mouse while holding down the key and stops at the corner diagonally opposite the first one to specify the rectangle and lets go of the key. At this point the coordinates of the corner diagonally opposite the first one are determined and this information is enough to specify the size and location of the zoom window. Of course, there are many other ways to determine this rectangular area without departing from the spirit and scope of the invention. The coordinates of the zoom window (including address in memory) are thus stored. As illustrated in FIG. 2, the coordinates of the zoom window are sent to the display driver in step 102.

The resolution of the destination can be either automatically calculated or user defined (step 103). When it is user defined, the software uses this resolution (step 104). In the preferred embodiment, it is automatic, it could be chosen in a variety of ways ranging from (but not limited to) the closest standard resolution (to the resolution of the zoom window) to the largest resolution possible etc. These resolutions determination options can also be specified by the user. Once the destination resolution is chosen, the scaling factor is determined (step 106). This determination of the scaling factor is within the general knowledge of those skilled in the art.

The resolution and thus the dimensions of the pixel array of the secondary zoom display device may be very different from the resolution and dimensions of the primary display device. For example, the secondary display could be a portrait display providing a zoom of a full page of text displayed within the main surface memory when a word processor application is running. This can allow a whole 8½" by 11" document page to be zoomed to full size and edited on the second display using a display as small as a 13" monitor, whereas a 20" monitor is required to view the same page when the monitor is operated in landscape mode. As mentioned above, there is a significant cost difference between a 13" and a 20" display, making the secondary 13" display operating in portrait mode an efficient use of display resources. The primary display can then be accessed for all toolbars and menus within the application, and the fixed portion of the main display containing the document page is displayed on the secondary display as a full page. If the secondary portrait display is configured to operate in portrait mode, then the selected window is directly zoomed. Portrait monitors and some flat panel displays can operate in this manner. If the secondary display operates in landscape mode and is simply turned on its side, then the selected window in the main surface memory may be copied into a buffer in memory 50 in a way so as to rotate the surface 90 degrees. The rotated surface can then be displayed on the landscape monitor turned 90 degrees on its side to provide a portrait display of the selected window.

Figure 3:
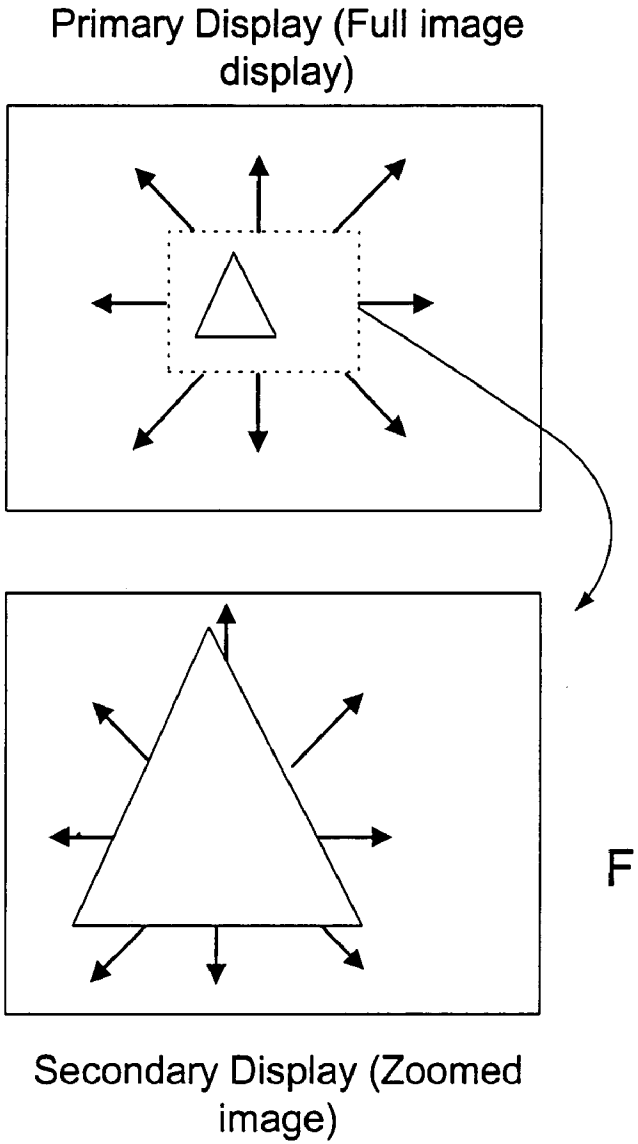
FIG. 3 illustrates a screen image of a primary and secondary display according to the preferred embodiments.

With knowledge of the destination resolution, a buffer of this resolution is reserved in memory (step 105) for the zoomed area (zoom buffer). As will be appreciated, multiple buffers can be allocated if double or triple buffering is desired and when multiple zoom windows are defined. The secondary CRTC is then programmed (step 107) to read from this zoom buffer (or set of zoom buffers). If the panning or mouse following feature is enabled (step 108) then the location of the zoom window is consistently updated (step 109), see FIG. 3. In this embodiment, the zoom window can be locked to the movement of the mouse and the zoomed area is updated in real-time.

The parameters associated with a zoom window or set of zoom windows or the selected portion or set or portions of the main surface memory to be displayed on the zoom display can be stored in association with a particular application program. This option may be selected or deselected by the user. When zoom windows are associated with applications, the launch of an application or switching to an application may automatically select the zoom window or set of zoom windows for the application. In the case that a number of zoom windows can be defined for the same display, and the user is allowed to toggle through the zoom windows, the selection of an application can be used to switch to the zoom window associated with the application, and thereafter, the user can toggle through the other zoom windows if a different zoom window is desired.

In this embodiment, the 3D drawing engine 60 of the graphics controller is used to scale the pixels from the main display buffer to the zoom buffer. While the scaling capabilities of the 3D drawing engine are typically used for scaling textures for 3D objects, the capability can easily be leveraged to scale any type of surface with pixels by treating the surface as a texture. If filtering is enabled then the 3D engine scales with filtering enabled. The type of filtering can include but is not limited to bilinear filtering.

Once the CRTC is programmed to operate according to the invention, it constantly reads from the appropriate zoom buffer and outputs to the display, while the 3D Drawing engine 60 keeps refreshing the appropriate zoom buffer with the scaled pixels from within the zoom window (the window may or may not be moving depending on the status of the panning feature).

FIG. 4 shows a representation of the hardware in an embodiment using 3D drawing engine 60 and two zoom buffers. The area selected in the main display buffer in memory 50 is scaled and written into the zoom buffer by the 3D drawing engine 60. FIG. 4 illustrates double buffering so two zoom buffers have been shown. In this case, the drawing engine 60 alternates between the two buffers. Meanwhile CRTC2 12 reads from the buffer that the drawing engine 60 has finished writing and while the drawing engine 60 is updating the other buffer. This is done to prevent unnecessary flickering that may occur with single buffering and to ensure that the drawing engine has completely updated the zoom buffer from which the CRTC2 12 is reading.

It will be appreciated that the hardware cursor which is overlaid on top of the main display may also need to be scaled so that is can be seen on the secondary display. Alternatively, the hardware cursor can simply be BLIT (bit block transferred or copied) into the zoom buffer directly (see FIG. 5).

CRTC1 11 reads the full image for the primary display from the primary display buffer (with the hardware cursor overlay) and CRTC2 12 reads the zoomed image from the zoom buffer and displays it on the secondary display (with the overlaid zoomed hardware cursor). It will be appreciated that the second display will always be a realtime zoomed version of the primary display. The user could chose to do all editing by looking at either display and it will get instantly updated on both displays.

Figure 6:
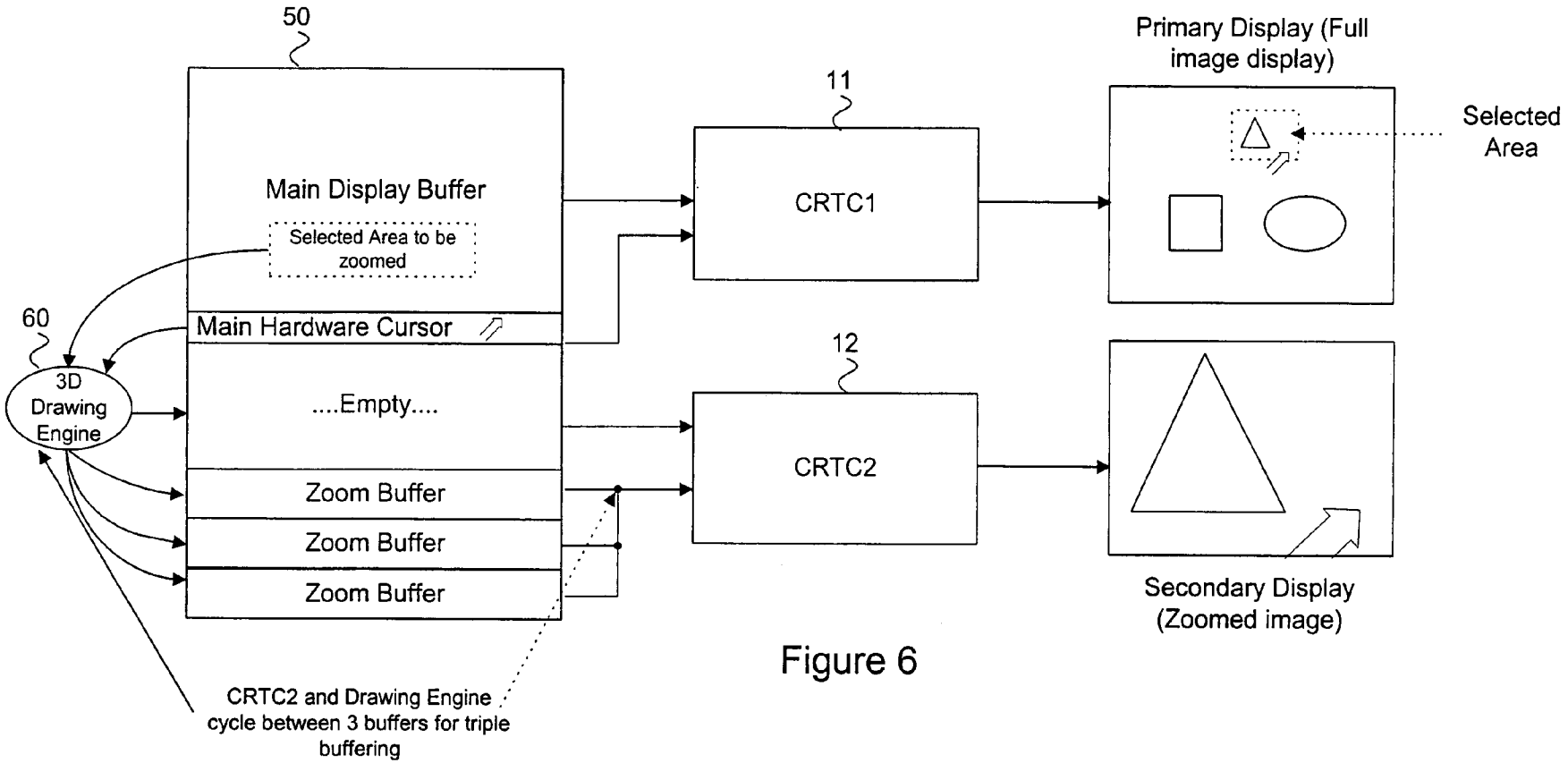
FIG. 6 is a high level block diagram illustrating the display controller system according to the fourth preferred embodiment in which the zoomed display toggles between three buffers.

FIG. 6 shows the same implementation with triple buffering. Three buffers are allocated in memory, and the 3D drawing engine 60 and CRTC2 12 cycle through these buffers. Triple buffering is useful for minimizing any dependencies that may be imposed by the refresh rate limitations of the particular display being used.

Figure 7:
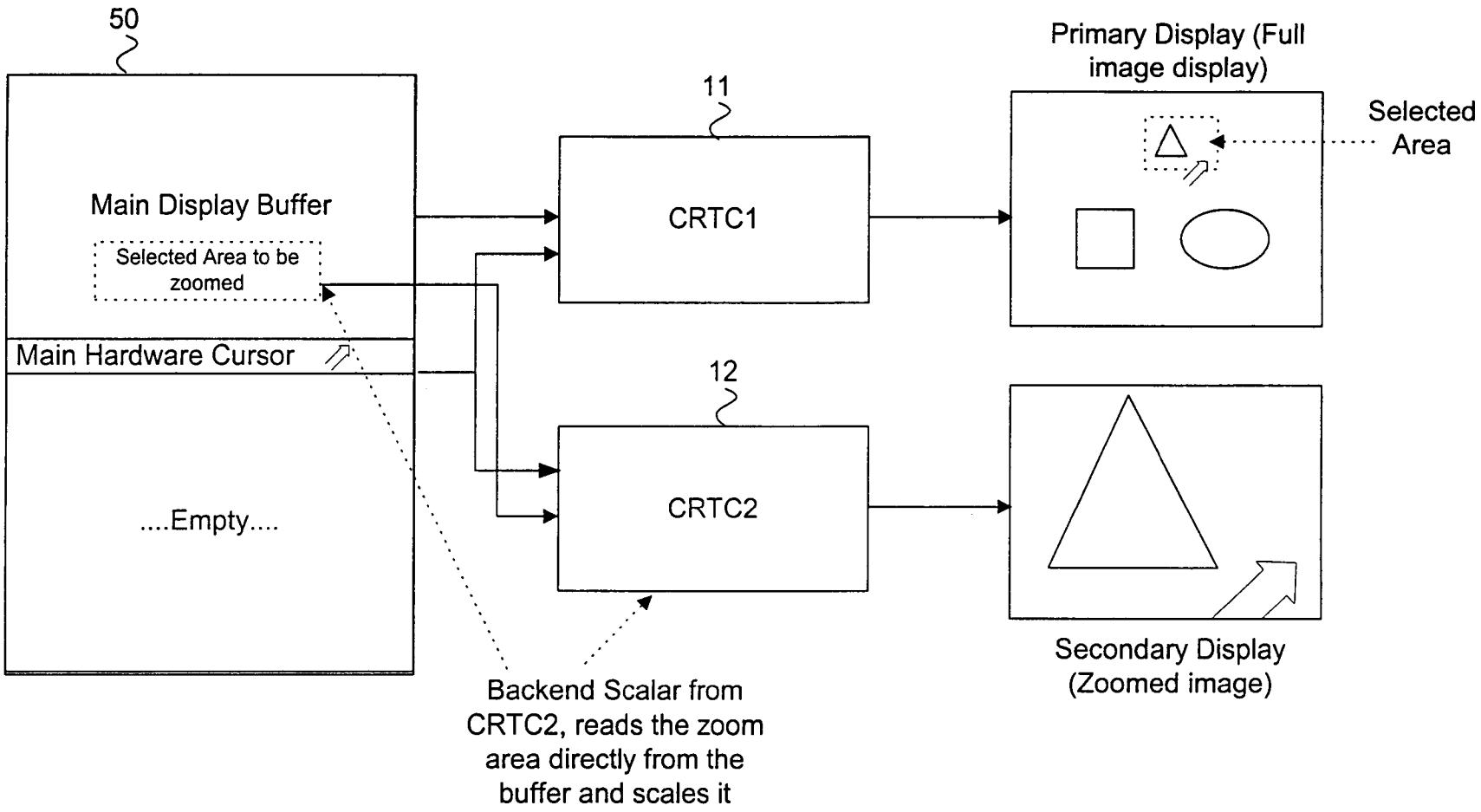
FIG. 7 is a high level block diagram illustrating the display controller system according to the fifth preferred embodiment in which the zoomed display CRTC reads the zoom area or portion of the main display, surface and uses its backend scaler to produce the zoomed image.
Figure 8:
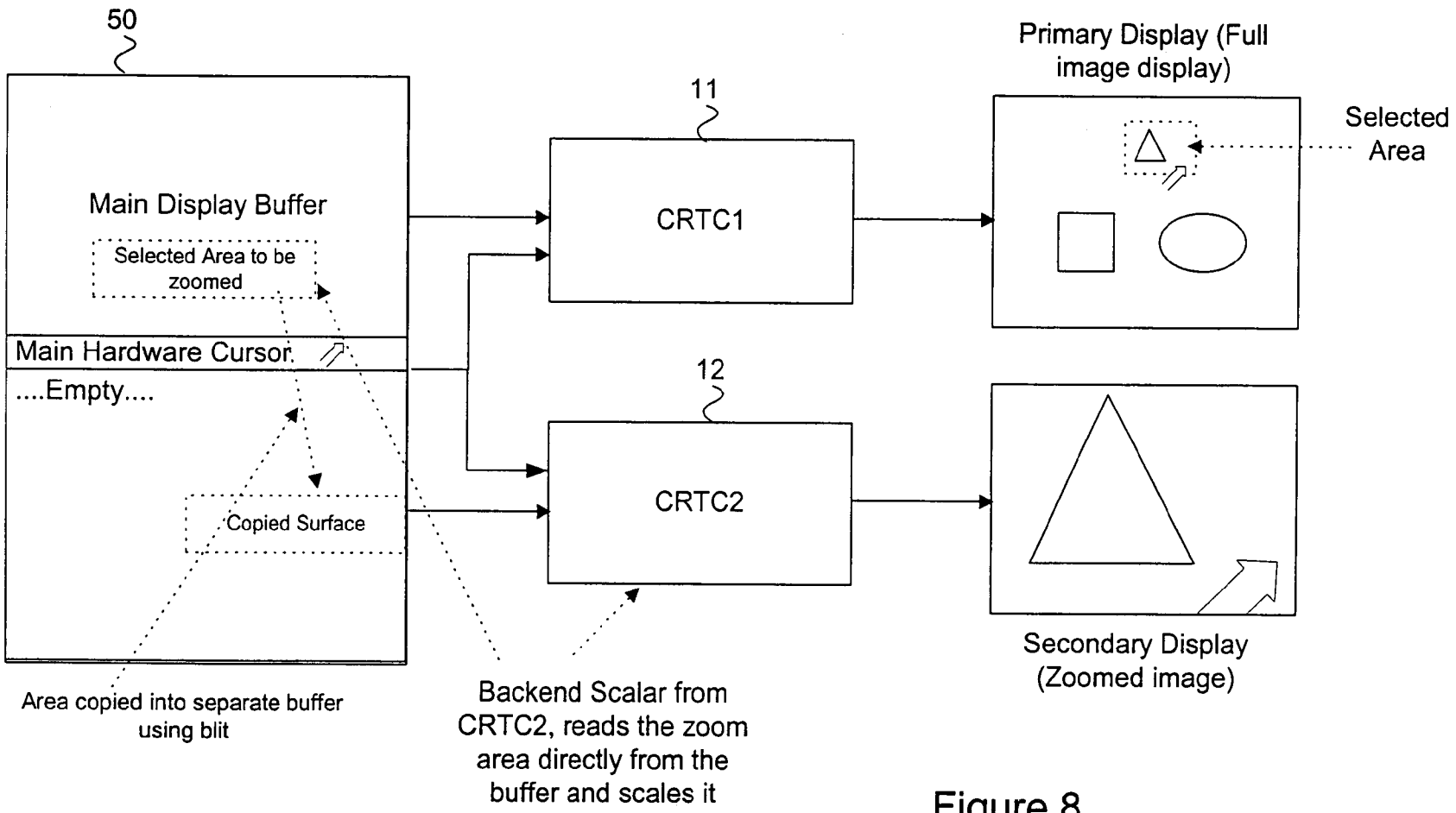
FIG. 8 is a high level block diagram illustrating the display controller system according to the sixth preferred embodiment in which the zoom area or portion of the main display surface is blit or copied into a separate buffer from which the zoomed display CRTC reads the zoom area and uses its backend scaler to produce the zoomed image.

Step 110 determines if filtering has been enabled or not. If so, a selected region is scaled using the 3D drawing engine texture mapper into the appropriate zoom buffer using filtering for ach pixel (step 111). If filtering has not been enabled, a selected region is scaled using the 3D drawing engine texture mapper into the appropriate zoom buffer without any filtering. Once the zoom operation is enabled, the hotkey is also detected (step 100') to determine if the zoom operation should be disabled (step 113). Alternatively to using the 3D drawing engine 60, the backend scaler of CRTC2 12 can also be used to scale the zoomed window (see FIG. 7). The CRTC2 12 is set to read from the location where the zoom window is located and the scaler is programmed to scale using the determined scale factor. The zoom window can be fetched directly from the main display buffer or the zoom window can be copied (blit) into another region in memory and the CRTC2 (12) can read from there (see FIG. 8). In this case, the control of filtering and non-filtering, will depend on the filtering capabilities of the specific scaling unit used.

While the description of the invention uses two controllers as the preferred embodiment, it can easily be extended or scaled to additional controllers.

It will be appreciated that the zoom control can accept user input for adjusting a non-integer scale value to be increased and to be decreased by very small steps by redefining a new zoom window whose length or width or both can be selected to the nearest pixel on the main display. This allows for the input to cause a sliding zoom magnification in either the upwards and downwards direction, i.e. either to increase the zoom magnification to a maximum value or to decrease the zoom magnification down to a minimum value, which may be actual size.

What is claimed is:

1. A method of controlling a display controller system to provide a display surface zoom, said display controller system having a main surface in a frame buffer memory, at least two displays, including at least one zoom display device, and output to the at least one zoom display device, the method comprising:

receiving user input defining coordinates of a frame portion within said main surface in the frame buffer memory;

determining a resolution of said at least one zoom display device and adjusting a scaling factor of said portion defined by said user input to correspond to said resolution;

causing said display controller system to implement said display surface zoom to provide a zoomed view of said portion on said at least one zoom display device;

in said display controller system, scaling said portion of said main surface in the frame buffer memory;

in said display controller system, converting said scaled portion of said main surface in the frame buffer memory into a display signal;

causing at least a first one of said displays to display a main surface view of said main surface in the frame buffer memory and outputting said display signal from said display controller system to said at least one zoom display device to cause simultaneous display of the main surface view on the at least first one of the displays and a view of the scaled portion on the at least one zoom display device; and updating in real time said zoomed view and said main surface view in response to an edit made to said main surface in the frame buffer memory.

2. The method as claimed in claim 1, wherein said step of converting includes incorporating a representation of a cursor in said display signal, said cursor having a position defined by a cursor position memory used for said main surface in the frame buffer memory.

3. The method as claimed in claim 1, further comprising a step of filtering said portion to provide for an image not illustrating coarse pixels.

4. The method as claimed in claim 1, wherein said user input further includes a cursor control device input used to control a cursor, and said portion is caused to be dragged or moved over said main surface in the frame buffer memory by movement of said cursor.

5. The method as claimed in claim 1, wherein said scaling comprises using a drawing engine of said display controller system to scale said portion into a buffer,

6. The method as claimed in claim 1, wherein said scaling comprises using a backend scaler of said display controller system to scale said portion.

7. The method as claimed in claim 6, wherein said scaling further comprises using a backend scaler of said display controller system to scale a hardware cursor associated with said portion.

8. The method as claimed in claim 5, wherein said scaling further comprises using a drawing engine of said display controller system to scale a hardware cursor associated with said portion into a separate hardware cursor buffer.

9. The method as claimed in claim 5, wherein said scaling further comprises using a drawing engine of said display controller system to scale a hardware cursor associated with said portion and overlay the scaled hardware cursor into said buffer.

10. The method as claimed in claim 1, wherein said scaled portion of said main surface is stored alternatingly in one of a plurality of buffers, and said converting comprises reading said scaled portion of said main surface alternatingly from one of said buffers so as to reduce image flicker and ensure complete buffer update before displaying.

11. The method as claimed in claim 1, wherein said scaled portion is displayed in a full screen view.

12. The method as claimed in claim 11, wherein said second display has a different image resolution than an image resolution of said first display, said converting comprising automatically adjusting an image resolution of said signal representing said portion to match said image resolution of said second display.

13. The method as claimed in claim 1, wherein said step of receiving user input comprises: receiving input defining at least two portions of said main surface to be selectively displayed on one of said at least one zoom display device; and receiving input selecting one of said at least two portions of said main surface to be displayed on said one of said at least one zoom display device.

14. The method as claimed in claim 13, wherein said user input causes a toggling between said portions.

15. The method as claimed in claim 13, wherein said step of receiving user input further comprises: associating said input defining said at least one said portion with one of a plurality of application programs, wherein said step of receiving input selecting one of said at least two portions comprises determining which one of a plurality of application programs is currently active and providing output to said main surface in the frame buffer memory in order to select from at least one of said portions of said main surface associated with said currently active one of said plurality of said application programs.

16. The method as claimed in claim 15, wherein a change in currently active application programs causes automatic selection of said at least one of said at least two portions.

17. The method as claimed in claim 1, wherein said step of receiving user input comprises: receiving input defining a plurality of portions of said main surface to be selectively displayed on different zoom display devices; and receiving input selecting one of said portions of said main surface to be displayed on each one of said zoom display devices.

18. The method as claimed in claim 17, wherein said user input causes a toggling between said portions.

19. The method as claimed in claim 1, wherein the determining the resolution of the at least one zoom display device comprises automatically choosing a standard resolution of the at least one zoom display device being closest to a resolution of said portion, and the causing said display controller system to implement said display surface zoom includes specifying to said display controller system said closest standard resolution.

20. The method as claimed in claim 19, wherein said at least one zoom display device comprises a CRT display.

21. A method of controlling a display controller system to provide a display surface zoom, said display controller system having a main surface in a frame buffer memory, output to a main display device, and output to at least one zoom display device, the method comprising causing the main display device to display at least a portion of said main surface in the frame buffer memory while:

receiving user input defining coordinates of a non-integer fractional portion of said main surface in the frame buffer memory to be scaled and displayed;

determining a resolution of said at least one zoom display device and adjusting a scaling factor of said fractional portion defined by said user input to correspond to said resolution;

causing said display controller system to implement said display surface zoom to provide a zoomed view of said fractional portion on said at least one zoom display device;

scaling said fractional portion of said main surface in the frame buffer memory;

converting said scaled fractional portion of said main surface in the frame buffer memory into a display signal;

outputting said display signal to said at least one zoom display device; and updating in real time said zoomed view and a main surface view in response to an edit made to said main surface in the frame buffer memory.

22. The method as claimed in claim 21, wherein said step of converting includes incorporating a representation of a cursor in said display signal, said cursor having a position defined by a cursor position memory used for said main surface in the frame buffer memory.

23. The method as claimed in claim 21, further comprising filtering said fractional portion to provide for an image not illustrating coarse pixels.

24. The method as claimed in claim 21, wherein said user input further includes a pointing device output used to control a cursor, and said fractional portion is caused to be dragged or moved over said main surface in the frame buffer memory by movement of said cursor.

25. The method as claimed in claim 21, wherein said scaling comprises using a drawing engine associated with said display controller system to generate image data corresponding to said fractional portion.

26. The method as claimed in claim 21, further comprising a step of accepting user input adjusting said non-integer fraction to be increased and to be decreased, wherein said user input can cause a zoom magnification to vary upwards and downwards.

* * * * *